US006183201B1

(12) United States Patent
Maby

(10) Patent No.: US 6,183,201 B1
(45) Date of Patent: Feb. 6, 2001

(54) SAFETY BLADE FOR CEILING FAN

(75) Inventor: Richard K. Maby, Mesa, AZ (US)

(73) Assignees: George Butler, III; Herminino Nazario; Carol Maby, all of Mesa, AZ (US)

( * ) Notice: Under 35 U.S.C. 154(b), the term of this patent shall be extended for 0 days.

(21) Appl. No.: 09/392,933

(22) Filed: Sep. 9, 1999

(51) Int. Cl.[7] ..... F04D 29/00
(52) U.S. Cl. ..... 416/170 R; 416/62
(58) Field of Search ..... 416/5, 62, 170 R, 416/224, 229, 230

(56) References Cited

U.S. PATENT DOCUMENTS 4,738,594 4/1988 Sato et al. ..... 416/224

*Primary Examiner*—F. Daniel Lopez
*Assistant Examiner*—James M. McAleenan
(74) *Attorney, Agent, or Firm*—Tod R. Nissle, P.C.

(57) ABSTRACT

A method and apparatus for reducing the risk that dust and other allergenic contaminants will accumulate on the leading edge of the blade of a ceiling fan. The apparatus reduces the risk of harm to an individual struck by the leading edge of a ceiling fan.

4 Claims, 4 Drawing Sheets

SAFETY BLADE FOR CEILING FAN

This invention pertains to fans.

More particularly, the invention pertains to a method and apparatus for reducing the risk that dust and other allergenic contaminants will accumulate on the leading edge of the blade of a ceiling fan.

In a further respect, the invention pertains to a method and apparatus for reducing the risk of harm to an individual struck by the leading edge of a ceiling fan.

The blade of a conventional ceiling fan has, as is depicted in FIG. 1, a squared-off leading edge. Movement of this edge through the air produces turbulent air flow 50 which promotes the accumulation of dust and other contaminants on the upper 51 and lower 52 surfaces adjacent the face 53 of the blade. In fact, over time surfaces 51 and 52 often become black as a result of the build up of dust, pollen, and other particles. When a ceiling fan is turned on and the blades begin to rotate, some of these particles escape into the air and are inhaled by inhabitants of the building in which the ceiling fan is mounted. In addition, pollen and other particles are believed to provide a food source for airborne bacteria, fungi, and other microorganisms, causing what appears to be a relatively harmless buildup of dust to function as a breeding ground for harmful disease-causing substances.

Accordingly, it would be highly desirable to provide an improved ceiling fan which would, to reduce the health risk associated with the ceiling fan, significantly reduce the accumulation of dust and other contaminants on the ceiling fan blades during operation of the ceiling fan.

Therefore, it is a principal object of the invention to provide an improved fan.

A further object of the instant invention is to provide an improved ceiling fan which functions to clean automatically and prevent the accumulation of dust and other particulate on top and bottom surfaces of the leading portion of the blades of the ceiling fan.

Another object of the invention is to provide an improved ceiling fan of the type described which includes blades each having a substantially rigid portion and a resilient leading edge which apportions air flow unequally between the top and bottom surfaces of the blade.

A further object of the invention is to provide an improved ceiling fan of the type described which includes blades each having a leading edge which flexes and alters shape during operation of the ceiling fan.

These and other, further and more specific objects and advantages of the invention will be apparent to those skilled in the art from the following detailed description thereof, taken in conjunction with the drawings, in which.

Figure 1:
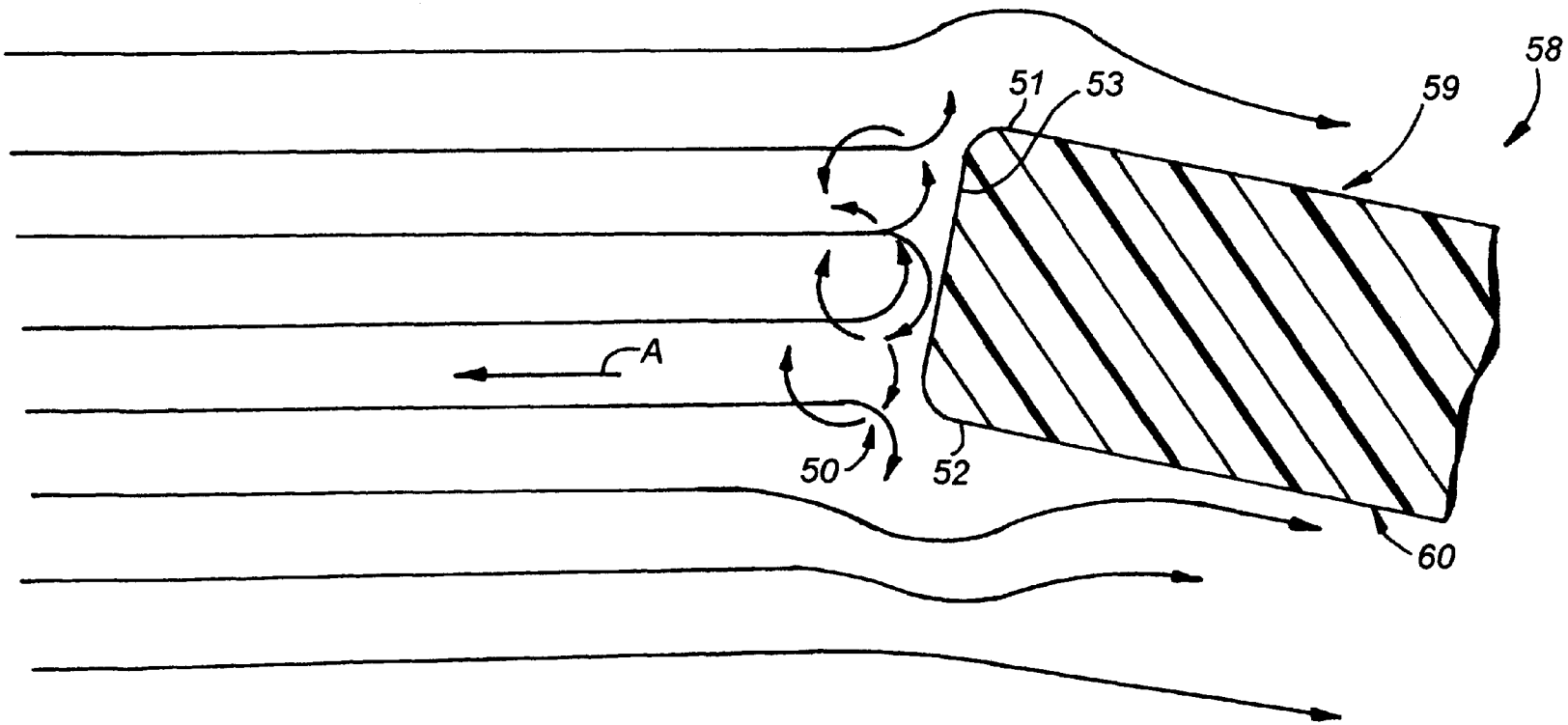
FIG. 1 (PRIOR ART)
FIG. 1 is a section view illustrating the leading edge of a conventional ceiling fan blade.

Briefly, in accordance with the invention, I provide an improved ceiling fan. The ceiling fan includes a motor; apparatus for mounting the motor on a ceiling; and, a plurality of fan blades connected to the motor. At least one of the blades has a leading portion including a leading edge; an arcuate upper surface extending from the leading edge; and, a lower surface extending from the leading edge. The upper surface and lower surface converge at the leading edge and are shaped and dimensioned such that the volume of air directed over the upper surface is greater than the volume of air directed over the lower surface.

In another embodiment of the invention, I provide, in combination with a ceiling fan, the improvements comprising a leading portion system for minimizing the quantity of particulate which accumulates on the ceiling fan. The ceiling fan includes a motor; apparatus for mounting the motor on a ceiling; and, a plurality of fan blades connected to the motor. Each one of the blades has a leading portion including a leading substantially flat planar face, an upper surface coterminating with and substantially normal to the flat planar face, the upper surface including a particulate accumulation area adjacent the flat planar face on which particulate normally accumulates during operation of the ceiling fan; and, a lower surface coterminating with and substantially normal to the flat planar face and substantially parallel to the upper surface. The leading portion system minimizes the quantity of particulate which accumulates on the particulate accumulation area. The leading portion system includes a leading edge; an upper surface including an arcuate portion extending from the leading edge, the upper surface extending over the particulate accumulation area; and, a lower surface extending from the leading edge. The upper surface and lower surface converge at the leading edge. The upper and lower surfaces and leading edge are shaped and dimensioned such that the air flow directed over the upper surface generally prevents particulate from accumulating directly above the particulate accumulation area.

In a further embodiment of the invention, I provide an improved method for preventing particulate from accumulating on a ceiling fan. The ceiling fan includes a motor; apparatus for mounting the motor on a ceiling; and, a plurality of fan blades connected to the motor. Each one of the blades has a leading portion including a leading substantially flat planar face; an upper surface coterminating with and substantially normal to the flat planar face, the upper surface including a particulate accumulation area adjacent the flat planar face on which particulate accumulates during operation of the ceiling fan; and, a lower surface coterminating with and substantially normal to the flat planar face and substantially parallel to the upper surface. The method includes the step of mounting airflow apparatus on the leading portion. The airflow apparatus includes a leading edge; an upper surface including an arcuate portion extending from the leading edge; and, a lower surface extending from the leading edge. The upper surface and lower surface converge at the leading edge. The upper and lower surfaces and leading edge are shaped and dimensioned such that the air flow directed over the upper surface generally prevents particulate from accumulating on the particulate accumulation area.

In still a further embodiment of the invention, I provide an improved method for altering the flow of air over a ceiling fan. The ceiling fan includes motive power apparatus; apparatus for mounting the motive power apparatus on a ceiling; and, a plurality of fan blades connected to the motive power apparatus for rotation by the motive power apparatus. Each one of the blades has a leading portion including a leading substantially flat planar face; an upper surface coterminating with and substantially normal to the flat planar face, the upper surface including a particulate accumulation area adjacent the flat planar face on which particulate accumulates during operation of the ceiling fan; and, a lower surface coterminating with and substantially normal to the flat planar face and substantially parallel to the upper surface. The improved method includes the step of mounting on the leading portion elastic airflow apparatus including a leading edge; an upper surface extending from the leading edge; and, a lower surface extending from the leading edge. The upper surface and lower surface converge at the leading edge. The airflow apparatus, when the leading portion is moved through air by the motive power apparatus at a selected speed, elastically deforms to alter the shape and dimension of the upper surface.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates the leading edge of a canted blade on a prior art ceiling fan. The conventional blade 58 on such a prior art fan takes the form of a generally rectangular panel. The leading edge—i.e., the edge that moves into the air when the fan motor moves the blade through the air in the direction of arrow A in FIG. 1—includes normally generally vertically oriented flat planar rectangular face 53 and the elongate planar canted areas 51 and 52 adjacent face 53. Area 51 comprises the elongate portion of the top planar surface 59 of blade 58 adjacent face 53. Area 52 comprises the elongate portion of the bottom planar surface 60 adjacent face 53.

When blade 58 moves through air in the direction of arrow A in conventional fashion, face 53 produces turbulent air flow 50 which, when the air eventually flows over surfaces 59 and 60, facilitates the deposit of dust particles on elongate areas 51 and 52. Such deposit of dust particles on areas 51 and 52 is promoted because there is only a minimal amount—if any—of air flow immediately next to areas 51 and 52. The spaces immediately above areas 51 and 52 tend to be "dead space" in which either air movement is minimized or particulate tends to slowly move in a restricted path until the particulate settles on or adheres to areas 51, 52.

The leading portion 20 of the invention is illustrated in FIGS. 2 to 5 and includes leading edge 14, upper surface 13, and lower surface 15. The shape and dimension of surfaces 13 and 15 can be altered as desired in accordance with one or more of the desired functions of the invention.

Figure 2:
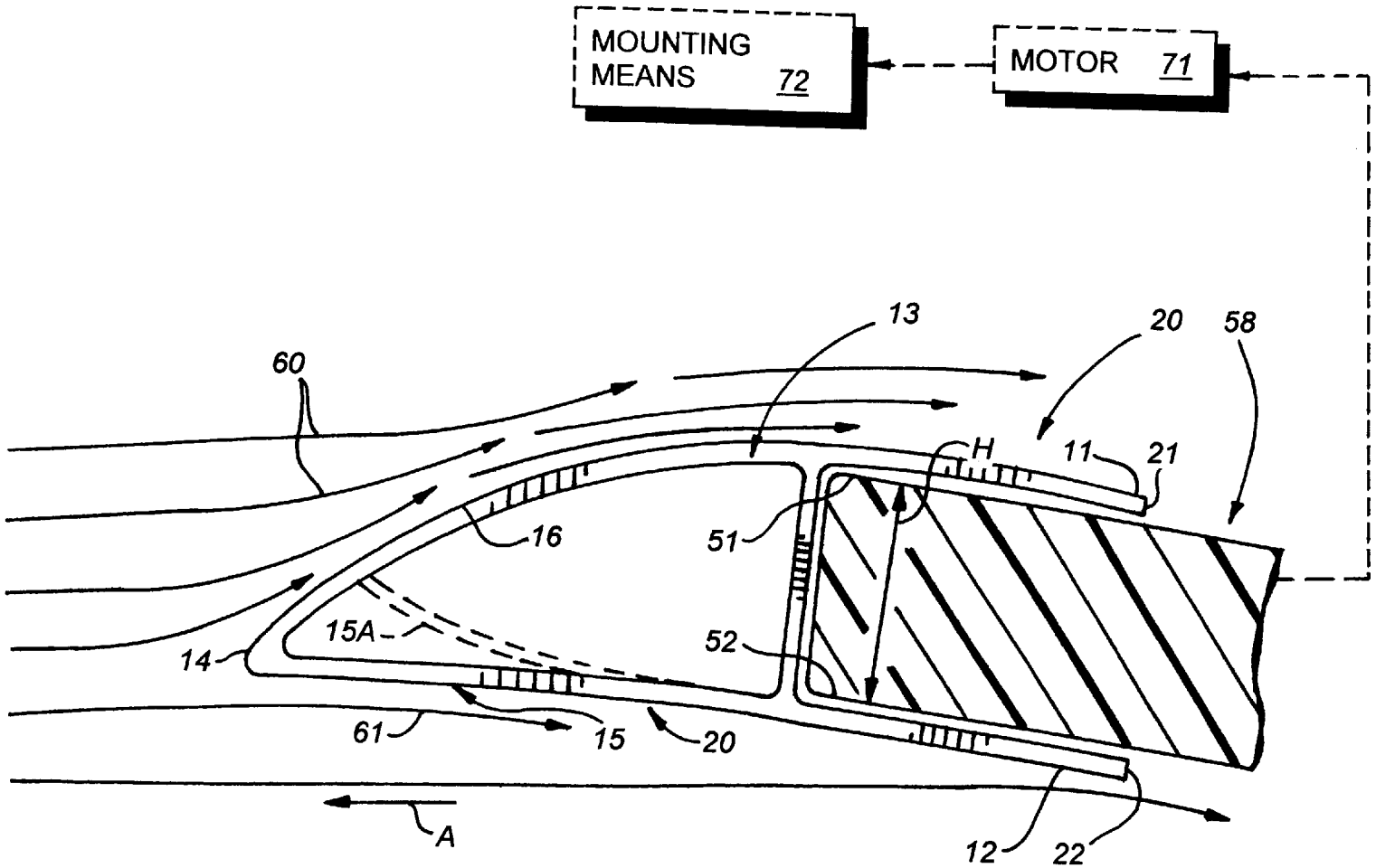
FIG. 2 is a side section view illustrating the leading edge of a ceiling fan blade constructed in accordance with the principles of the invention.
Figure 3:
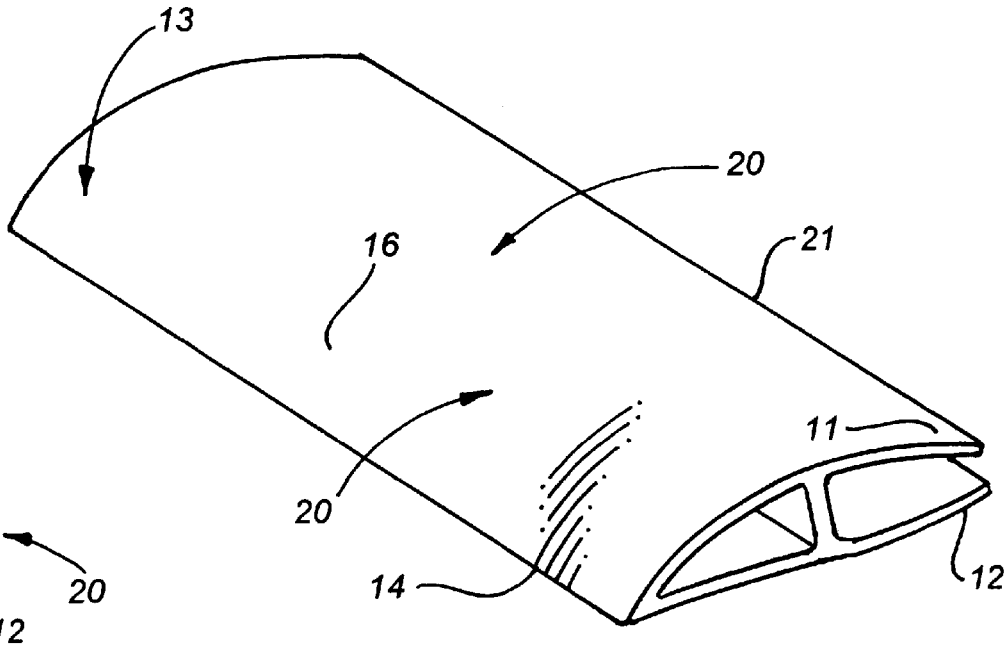
FIG. 3 is a perspective view further illustrating the leading edge of FIG. 2.
Figure 5:
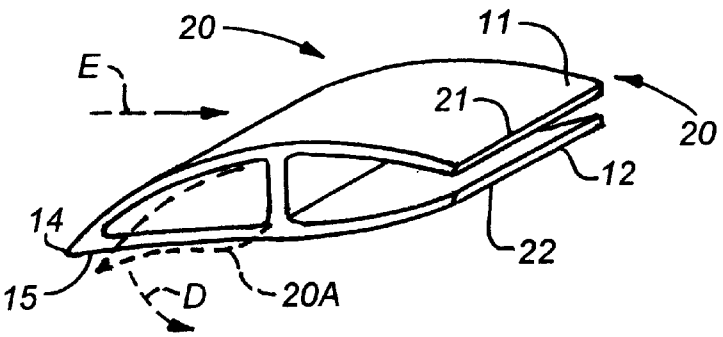
Figure 4:
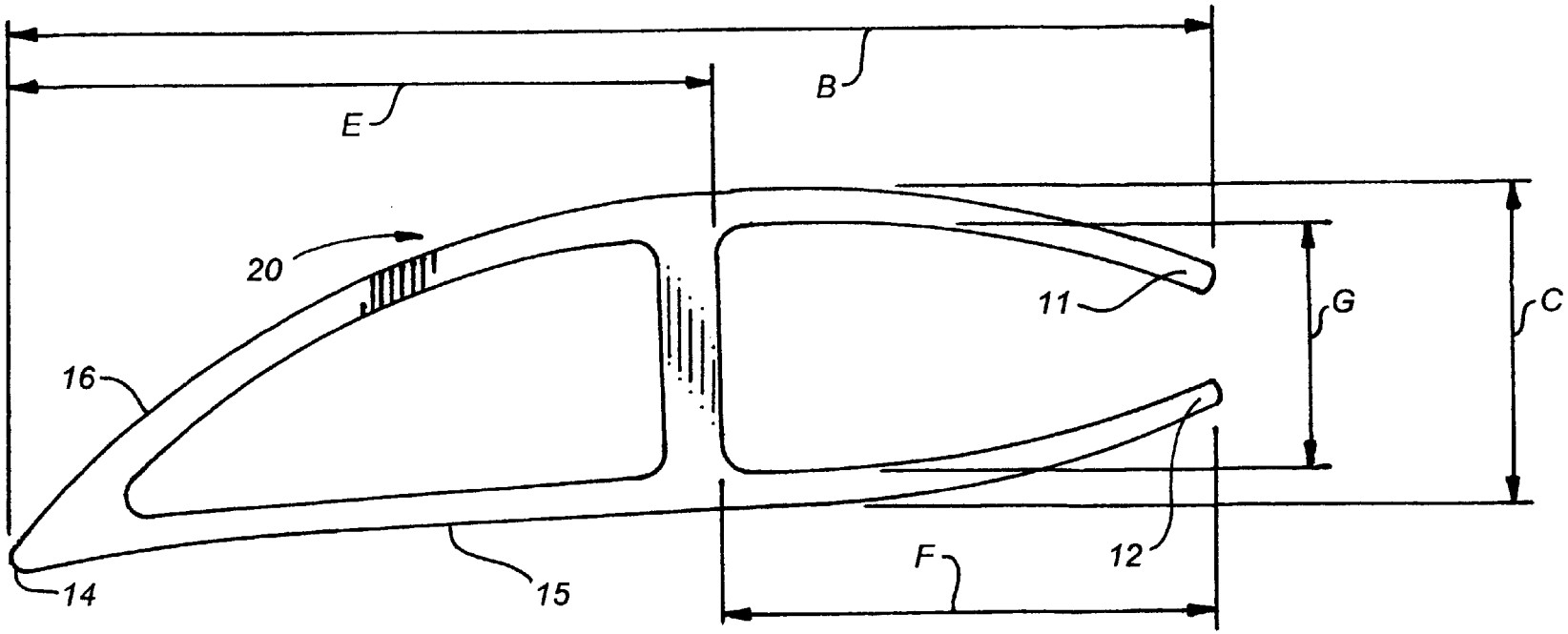
FIG. 4 is an enlarged end view of the leading edge of FIG. 2 illustrating construction details thereof; and, FIG. 5 is a perspective view of the leading edge of FIG. 2 illustrating the mode of operation thereof.

Leading portion 20 is presently mounted on the leading edge of blade 58 by spreading apart elastic arms 11 and 12 and sliding arms 11 and 12 over the leading edge 14 until portion 20 is positioned in the manner illustrated in FIG. 2.

Upper surface 13 extends from leading edge 14 to the trailing linear edge 21 of arm 11. Lower planar surface 15 extends from leading edge 14 to the trailing linear edge 22 of arm 12. Surface 13 includes arcuate planar convex surface 16. As used herein, the terminology "planar surface" encompasses both two-dimensional smooth flat surfaces on which two points are interconnected by a straight line, and encompasses three dimensional smooth arcuate surfaces like the outer surfaces of a cylinder, of a sphere, and of a cone.

Surface 13 includes arcuate convex surface 16 extending from edge 14. Surface 16 currently is shaped to extend upwardly from edge 14 through a height approximately equal to the height, indicated by arrows H, of face 53. Since surface 16 extends through the majority of the height of face 53, surface 16—during any selected period of time when blade 58 is moving through the air in the direction of arrow A—directs 60 a greater volume of air above area 51 and surface 16 than the volume of air 61 traveling beneath area 52 and surface 15. The shape and dimension of surface 13 also prevents a "no-air flow" "dead area" from forming on surface 13 directly above area 51. The flow or movement of air directly over surface 13 directly above area 51 "sweeps" or "cleans" particulate off surface 13 and generally prevents particulate from accumulating on surface 13 immediately above area 51. The shape and dimension of surface 16 and the remainder of surface 13 also promotes airflow over all or nearly all of surface 13 and functions generally to prevent or minimize the accumulation of dust thereon.

In the event dust accumulates on convex surface 15 (or surface 16), leading portion 20 is readily removed from blade 58, cleaned, and reinstalled on the leading edge of blade 58. In order to minimize dust accumulation on surface 15, it is possible to form surface 15 in a convex shape indicated by dashed lines 15A in FIG. 2, in which case surface 16 extends upwardly through only a smaller portion of the height H of surface 53.

Leading portion 20 is preferably fabricated from an elastic rubber or plastic or other elastic and/or pliable material. Portion 20 will resiliently bend downwardly in the direction indicated by dashed arrow D and in the manner indicated by dashed lines 20A when portion 20 hits an individual while blade 58 is moving through the air. After being resiliently displaced in the direction of arrow D and after portion 20 no longer contacts the individual, portion 20 returns to its normal shape illustrated in FIGS. 1 to 4. The ability of portion 20 to resiliently deform reduces the likelihood that blade 58 will cause an injury on hitting an individual.

It is also preferable that portion 20 deform in the direction of arrow D (in or any other desired direction or directions) either while motor 71 accelerates blade 58 from a stationary position to a selected speed or while blade 58 is moving through air at a relatively constant selected speed. The selected speed at which portion 20 deforms can be any desired speed, but typically consists of the medium or fast setting of a ceiling fan. Most conventional ceiling fans have—as is well known—slow, medium, and fast settings. The forces generated against portion 20 by air cause portion 20 to deform either when either the fan blade is accelerating or is moving through the air at a selected speed setting for the fan. The ability of portion 20 to deform, even slightly, is advantageous because such deformation tends to loosen dust particles which have settled on surface 16 or surface 13. The downward deformation by air 60 of portion 20 in the direction of arrow D also tends to deflect more air upwardly over surface 16 and over the remainder of surface 13 to enhance the cleaning effect produced by the flow of the air over surface 13. When portion 20 deforms, the curvature of surfaces 16 and 15 is altered.

Mounting means 22 is utilized to secure motor 21, blades 58, and the remaining portion of the fan structure to the ceiling. As is well known in the art, means 22 can includes brackets, screws, etc.

Having described my invention in such terms as to enable those of skill in the art to make and practice it, and having described the presently preferred embodiments thereof, I claim:

1. A ceiling fan including (a) a motor;

(b) means for mounting said motor to a ceiling;

(c) a plurality of fan blades connected to said motor, at least one of said blades having a leading portion including (i) a leading edge, (ii) an arcuate upper surface extending from said leading edge, (iii) a lower surface extending from said leading edge, said upper surface and lower surfaces converging at said leading edge, said upper and lower surfaces and leading edge being shaped and dimensioned such that the volume of air directed over said upper surface is greater than the volume of air directed over said lower surface.

2. In combination with a ceiling fan including a motor, means for mounting said motor to a ceiling;

a plurality of fan blades connected to said motor, each one of said blades having a leading portion including a leading substantially flat planar face, an upper surface coterminating with and substantially normal to said flat planar face, said upper surface including a particulate accumulation area adjacent said flat planar face on which particulate accumulates during operation of said ceiling fan, a lower surface coterminating with and substantially normal to said flat planar face and substantially parallel to said upper surface, the improvement comprising leading portion means for minimizing the quantity of particulate which accumulates on said particulate accumulation area, said leading portion means including (a) a leading edge;

(b) an upper surface including an arcuate portion extending from said leading edge, said upper surface extending over said particulate accumulation area;

(c) a lower surface extending from said leading edge, said upper surface and lower surfaces converging at said leading edge, said upper and lower surfaces and leading edge being shaped and dimensioned such that the air flow directed over said upper surface generally prevents particulate from accumulating on said blade directly above said particulate accumulation area.

3. A method for preventing particulate from accumulating on a ceiling fan, said ceiling fan including a motor, means for mounting said motor to a ceiling;

a plurality of fan blades connected to said motor, each one of said blades having a leading portion including a leading substantially flat planar face, an upper surface coterminating with and substantially normal to said flat planar face, said upper surface including a particulate accumulation area adjacent said flat planar face on which particulate accumulates during operation of said ceiling fan, a lower surface coterminating with and substantially normal to said flat planar face and substantially parallel to said upper surface, said method including the step of mounting on said leading portion airflow means including (a) a leading edge;

(b) an upper surface including an arcuate portion extending from said leading edge;

(c) a lower surface extending from said leading edge, said upper surface and lower surfaces converging at said leading edge, said upper and lower surfaces and leading edge being shaped and dimensioned such that the air flow directed over said upper surface generally prevents particulate from accumulating on said particulate accumulation area.

4. A method for altering the flow of air over a ceiling fan, said ceiling fan including motive power means, means for mounting said motive power means to a ceiling;

a plurality of fan blades connected to said motive power means for rotation by said motive power means, each one of said blades having a leading portion including a leading substantially flat planar face, an upper surface coterminating with and substantially normal to said flat planar face, said upper surface including a particulate accumulation area adjacent said flat planar face on which particulate accumulates during operation of said ceiling fan, a lower surface coterminating with and substantially normal to said flat planar face and substantially parallel to said upper surface, said method including the step of mounting on said leading portion elastic airflow means including (a) a leading edge;

(b) an upper surface extending from said leading edge;

(c) a lower surface extending from said leading edge, said upper surface and lower surfaces converging at said leading edge, said airflow means, when said leading portion is moved through air by said motive power means at a selected speed, elastically deforming to alter the shape and dimension of said upper surface.

* * * * *